United States Patent [19]

Young

[11] Patent Number: 4,916,872

[45] Date of Patent: Apr. 17, 1990

[54] LIGHT WELL

[76] Inventor: Edgar C. Young, P.O. Box 432, Ironia, N.J. 07845

[21] Appl. No.: 151,615

[22] Filed: Feb. 2, 1988

[51] Int. Cl.[4] ..... E04B 7/18

[52] U.S. Cl. ..... 52/200; 52/22

[58] Field of Search ..... 52/200, 19, 22

[56] References Cited

U.S. PATENT DOCUMENTS

| | | | |
|---|---|---|---|
| 2,056,270 | 10/1936 | Harbert | 52/19 |
| 3,012,375 | 12/1961 | Wasserman | 52/19 |
| 3,434,250 | 3/1969 | Kiekhaefer | 52/200 |
| 3,749,908 | 7/1973 | Esser | 52/200 |
| 3,839,949 | 10/1974 | Gobel | 52/200 |
| 3,924,372 | 12/1975 | Anghinetti | 52/232 |
| 3,934,383 | 1/1976 | Perry | 52/200 |
| 4,339,900 | 7/1982 | Freeman | 52/200 |
| 4,473,979 | 10/1984 | Bruhm | 52/200 |

FOREIGN PATENT DOCUMENTS

| | | | |
|---|---|---|---|
| 244303 | 1/1962 | Australia | 52/200 |

*Primary Examiner*—Henry E. Raduazo

*Attorney, Agent, or Firm*—Bernard John Murphy

[57] ABSTRACT

A factory molded, manufactured light well, or chase way, for a skylight includes sides, a flange, and ledges. The light well is made from such material as fiberglass, plastic, arcylic, dense styrofoam, or other such moldable material. The sides form the light well proper. The flange is of a single molding with the sides; forms the base, or lower edge, of the sides; and flares perpendicularly outward from the interior of the light well. The flange provides the means of finish trimming the edge of the box framed hole cut in the ceiling immediately below the skylight. The means of attachment to the box framing of the ceiling hole consists of ledges, of a single molding with the sides. The ledges protrude from the exterior of the sides and parallel the flange around all the sides. Under these ledges, standard framing lumber can be placed and secured to the box framing, thus rigidly attaching the light well to the ceiling and its framing. The sides of the light well are cut by the installer so as to nearly abut to the lower edge of the skylight or to the box framing of the skylight. Should an upper extension of the light well be required, a joinable section can be secured to the upper edge of the sides of the basic light well. A tongue and groove method is used for joining, with the base of the joinable section as the groove and the upper edge of the sides of the basic light well as the tongue. Setscrews provide the means of securing.

6 Claims, 1 Drawing Sheet

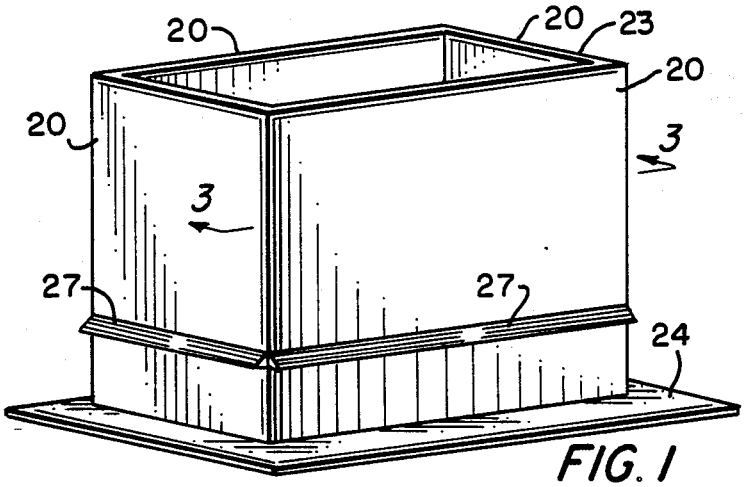
FIG. 1
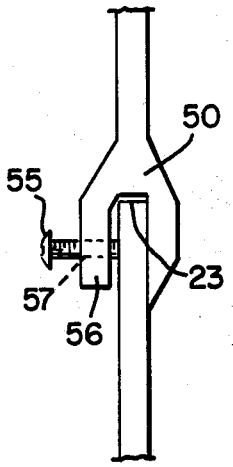
FIG. 5
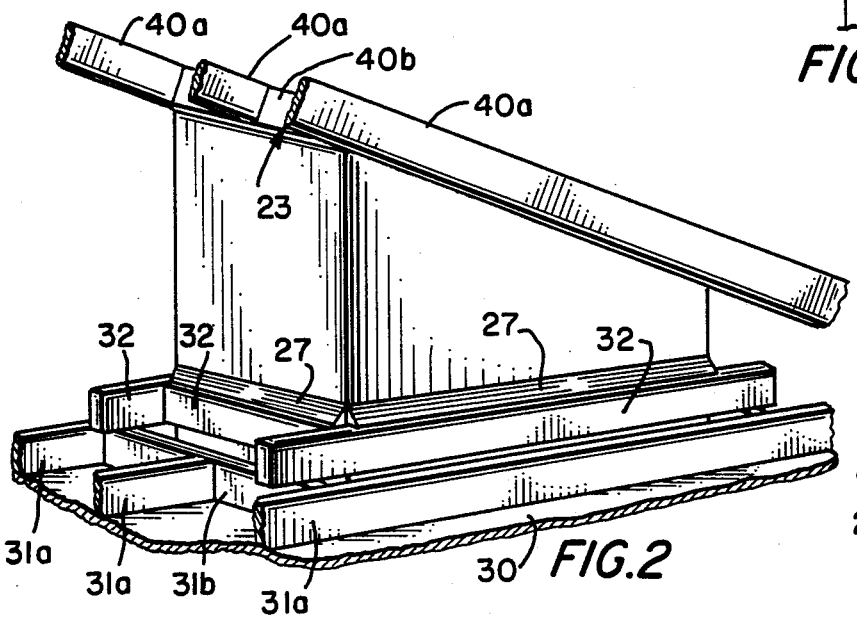
FIG. 2
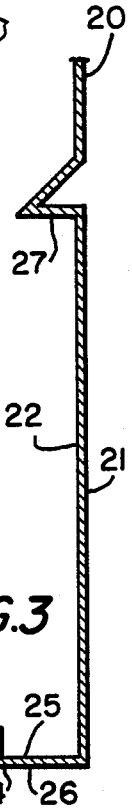
FIG. 3
FIG. 4
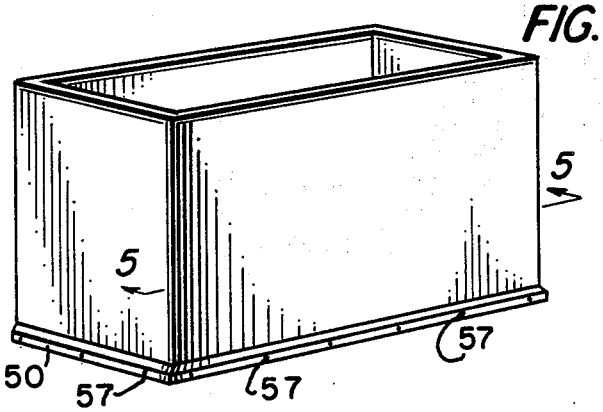

LIGHT WELL

This invention relates in general to residential and commercial construction. Installation of skylights involves the opening of a hole in the roof and the box framing of that hole. Over the hole a skylight is installed. In the case of pitched roofs over attic space, a hole must also be opened in the ceiling immediately below the skylight and that ceiling hole box framed. In order to structurally join the box framed hole in the roof and the box framed hole in the ceiling below, current construction methods require that a framing structure be built between them. Thus, a chase way is framed between roof and ceiling. This chase way, as constructed for the purpose of a skylight, is commonly called a light well.

The framed chase way must then be sheetrocked, beaded at the joining point with the ceiling sheetrock, spackled with several coats and painted. Skilled or semi-skilled labor is required. Construction time is measured in days since time must be allowed for the spackle to harden between coats and before painting. This construction time constitutes both labor expense and inconvenience to the one having the skylight and light well installed. The more angles and slopes desired in the shape of the light well, the more difficult and expensive becomes the task of construction.

Furthermore, the construction materials of framing lumber and sheetrock limit the feasibility of rounded and complex shapes of light wells. Such rounded and complex shapes as might be imagined would be cylindrical, oval at the base and rectangular at the top, rectangular but with rounded corners, heart-shaped, kidney-shaped, and so forth.

A manufactured light well, molded in whole or in joinable sections, is made from such material as fiberglass, plastic, acrylic, dense styrofoam or other such moldable material. A manufactured light well would require less construction skill to install and would greatly reduce the time required to provide a finished light well. This, in turn, would reduce expense and inconvenience. Furthermore, molding of such material would allow for rounded and complex shapes, suited to a greater variety of requirements and preferences. Yet another advantage of using such material for a light well would be that such material is highly resistant to water damage. Water damage, due to leakage from the skylight or due to condensation, is a common problem related to skylights and light wells.

BRIEF DESCRIPTION OF THE DRAWINGS

FIG. 1 is a perspective view of a rectangular shaped, manufactured light well as it would look as a manufactured product, prior to field modification and installation.

FIG. 2 is a perspective view of FIG. 1 light well. The light well is shown installed, with its upper edge cut so as to abut to the sheathing of a pitched roof. Included for illustrative purposes are: the box framed roof rafters, at the hole made in the roof for the skylight; box framed ceiling joists, at the hole made in the ceiling immediately below the skylight; and light well support lumber.

FIG. 3 is an exploded, sectional view of the lower portion of one side of FIG. 1 light well, taken along line 3—3 in FIG. 1. Included for illustrative purposes is ceiling sheetrock.

FIG. 4 is a perspective view of a rectangular shaped, manufactured upper extension for a light well as it would look as a manufactured product, prior to field modification and installation.

FIG. 5 is an exploded, sectional view of the lower portion of one side of FIG. 4 upper extension, joined to the upper edge of FIG. 1 light well. This sectional view is taken along line 5—5 in FIG. 4 and along line 3—3 in FIG. 1.

DESCRIPTION OF THE PERFERRED EMBODIMENT

In order to make the nature of the invention clear, the following will describe the embodiment illustrated in the drawings. Specific language will be used, but it is not intended that the basic nature of the invention be limited by such details as will be used to describe it.

FIG. 1 is an illustration of a manufactured, rectangular shaped chase way to be used as a light well. The light well is molded, in whole or in joinable sections, from such material as fiberglass, plastic, acrylic, dense styrofoam and so forth. It is illustrated as it might look as a manufactured product, prior to any field modification.

Continuing to refer to FIG. 1, the light well includes sides (20), support ledges (27), and a flange (24). The sides (20) constitute the light well proper and, in this illustration, the four sides (20) are of one molded piece with each other so as to form, more or less, a hollow cube or channel, with neither top nor bottom, formed of a continuous and fully circumscribing wall. The flange (24) is of one molded piece with the sides (20) in this illustration. The flange (24) protrudes perpendicularly out from the sides (20) at the bottom of each and is continuous around the base of the light well, though FIG. 1 shows the flange (24) and the sides (20) only as they might be seen from one angle. Referring to FIG. 3, the ledges (27) protrude from the exterior surface of the sides (22) some distance from the flange (24). Each ledge (27) is of one molded piece with the side (20) to which it is attached.

Referring to FIG. 2, the installer of this invention would cut a hole in the ceiling, removing a section of ceiling sheetrock (30) and sections of ceiling joists (**31*a*) immediately above that section of sheetrock (30). The hole thus made would be box framed with headers (31*b*). Referring to FIG. 3, this hole would need to be of large enough dimensions to allow the sides (20) and ledges (27) of the light well to be slipped through it from below, but small enough so that the cut edges of the sheetrock (30) would be covered completely by the flange (24). Thus installed, the flange (24) provides the means of finish trimming the edge at which the sides (20) of the light well abut to the ceiling sheetrock (30**).

Referring again to FIG. 2, prior to installing the light well, the installer would need to cut the upper edge of the sides (23) along lines such that the upper edge of the sides (23) will abut at every point to the skylight (not shown) or to its box framing consisting of roof rafters (**40*a*) and headers (40*b*). Assumed in FIG. 2 for illustrative purposes is that the skylight has been installed upon a pitched roof, with the roof rafters (40*a*) cut and supplied with headers (40*b***).

With the upper edge of the sides (23) thus cut, the installer would slip the light well sides (20) and ledges (27) through the hole in the ceiling sheetrock (30), as has already been described. Referring to FIG. 3, the upper surface of the flange (25) would sit flush with the ceiling sheetrock (30). Referring to FIG. 2, the upper edge of the sides (23) would abut to the above skylight or to its box framing, consisting of roof rafters (40*a*) and headers (40*b*). Support framing lumber (32) would be placed under the ledges (27), thus forming a tight fit between the base of each ledge (27) and the ceiling hole box framing, consisting of ceiling joists (31*a*) and headers (31*b*). Toe-nailing the support framing lumber (32) would be an appropriate means of rendering the support framing lumber (32) secure. Referring again to FIG. 3, thus installed, the ledges (27) provide a means for supporting the light well from the exterior surface of the sides (22), leaving the interior surface of the sides (21) and the lower surface of the flange (26) unaltered and unmarred by the installation process.

Should the distance between ceiling and roof be so great so as to make a manufactured light well of one molded piece impractical, an upper extension to the light well can be provided by a joinable section. FIG. 4 is an illustration of a manufactured, rectangular shaped chase way to be used as an upper extension of a light well. This joinable section is molded from such material as fiberglass, plastic, acrylic, dense styrofoam or other such moldable material. It is illustrated as it might look as a manufactured product, prior to field modification or installation. The joinable section is designed to be joined at its base (50) with (FIG. 1) the upper edge of the sides (23) of the basic light well, with the length and width of said base and said upper edge exactly corresponding.

FIG. 5 is an illustration of the proposed means of joining and securing the base of the joinable section (50) to the upper edge of the sides (23) of the basic light well. The proposed means of joining said base and said upper edge is a tongue and groove assembly, with the base of the joinable section (50) as the groove and the upper edge of the sides (23) of the basic light well as the tongue. The proposed means of securing said tongue to said groove is setscrews (55) in threaded holes (57) located in the outer lip of the groove (56) of the tongue and groove assembly. Referring to FIG. 4, the threaded holes (57) are located at various points on the base of the joinable section (50).

What is claimed is:

1. A channel, or cube unit, for use in a light well, said light well being of the type comprising an opening through a plaster or sheetrock ceiling supported by ceiling joists, said channel comprising:

a one-piece, circumscribing wall dimensioned to fit through said opening, having first and second open extremities;

a first means integral with and extending outwardly from said first extremity for interfacingly mating with said plaster or sheetrock ceiling about said opening; and a second means integral with, and extending outwardly from, a location between said first and second extremity, and located such that a linear support means may be interposed between said second means and said ceiling joists to cause said first means to come into mating engagement with said plaster or sheetrock ceiling.

2. A channel, or cube unit, for use in a light well, according to claim 1, wherein:

said first means comprises a flange.

3. A channel, or cube unit, for use in a light well, according to claim 1, wherein:

said circumscribing wall is rectilinear in cross section, and has a pair of parallel sides; and said second means comprises ledges extending from said sides.

4. A channel, or cube unit, for use in a light well, according to claim 1, wherein:

said circumscribing wall has opposite sides; and said second means comprises ledges extending from said sides.

5. A channel, or cube unit, for use in a light well, according to claim 1, wherein:

said first means comprises means for contactingly engaging such plaster or sheetrock about such opening.

6. A channel, or cube unit, for use in a light well, according to claim 1, wherein:

said second means is integral with said circumscribing wall.

* * * * *